United States Patent [19]

Reed

[11] Patent Number: 4,939,824

[45] Date of Patent: Jul. 10, 1990

[54] VEHICLE SAFETY BELT BUCKLE COVER

[76] Inventor: Delores A. Reed, 9739 Harmony Dr., Indianapolis, Ind. 46231

[21] Appl. No.: 392,599

[22] Filed: Aug. 11, 1989

[51] Int. Cl.[5] ..... A41F 1/00; A44B 11/25

[52] U.S. Cl. ..... 24/633; 24/573.1

[58] Field of Search ..... 24/633, 634, 574, 306, 24/442; 297/482; 128/DIG. 15; 2/DIG. 6

[56] References Cited

U.S. PATENT DOCUMENTS

| | | | |
|---|---|---|---|
| 2,442,855 | 6/1948 | Luftig | 2/322 |
| 3,484,908 | 12/1969 | Lamb | 24/574 |
| 4,040,632 | 8/1977 | Pawl | 128/DIG. 15 |
| 4,120,052 | 10/1978 | Butler | 2/DIG. 6 |
| 4,286,588 | 9/1981 | Lovegrove | 128/DIG. 15 |
| 4,502,194 | 3/1985 | Morris et al. | 24/633 |
| 4,595,618 | 6/1986 | Caringer | 428/100 |
| 4,624,033 | 11/1986 | Orton | 24/633 |
| 4,674,303 | 6/1987 | Salcone, II | 24/633 |
| 4,675,954 | 6/1987 | Gullickson | 24/633 |
| 4,731,912 | 3/1988 | Boriskie et al. | 24/633 |

FOREIGN PATENT DOCUMENTS

| | | | |
|---|---|---|---|
| 3445822 | 8/1986 | Fed. Rep. of Germany | 297/482 |

*Primary Examiner*—Victor N. Sakran

*Attorney, Agent, or Firm*—Willian Brinks Olds Hofer Gilson & Lione

[57] ABSTRACT

A cover for vehicle safety belt buckles for preventing opening of a vehicle safety belt by young children or the like. The cover comprises a covering member for covering the buckle and for preventing or rendering more difficult the operation of belt releasing means on the buckle, and means for releasably securing the cover to the safety belt. The cover of the present invention can be easily installed on or removed from a vehicle safety belt by an adult, and when installed, will substantially prevent a young child from intentionally or accidentally opening the safety belt.

2 Claims, 1 Drawing Sheet

VEHICLE SAFETY BELT BUCKLE COVER

TECHNICAL FIELD

The present invention relates generally to a cover for vehicle safety belt buckles; and, more particularly, to a vehicle safety belt buckle cover for preventing the opening of a vehicle safety belt by small children or the like.

BACKGROUND ART

The usage of vehicle safety belts for increased passenger safety is widespread and is encouraged or required by various safety and regulatory bodies. The importance of using safety belts is especially great in the instance of small children, not only to reduce the risk of serious injury as a result of an accident, but also to prevent children from roaming about the vehicle, opening doors, and the like.

Vehicle safety belts typically include a belt portion which is adapted to extend around the body of the user, and a buckle portion having a buckle for engaging the end of the belt portion to secure the safety belt in position around the user. In most vehicle safety belts, the belt portion is automatically secured to the buckle portion by inserting the end of the belt portion into the buckle.

To release the safety belt, the buckle includes a releasing means which is adapted to be operated by the user. In many safety belts the releasing means comprises a button on the upper surface of the buckle which need only be depressed by one's finger to release the belt portion from the buckle portion to permit the safety belt to be opened.

Safety belt releasing means, such as button-type releasing means, are usually easy to operate, and even very small children are capable of operating them with little difficulty. This can be quite dangerous. Children are often seated in the back seat of a vehicle while the parents are in the front seat and the parents may be unaware that a child has opened his safety belt and is no longer restrained thereby.

SUMMARY OF THE INVENTION

The present invention provides a cover for vehicle safety belt buckles which is effective in preventing young children from operating the releasing means on the safety belt buckle, and, hence, from intentionally or accidentally opening a safety belt. The cover, according to the invention, is adapted to be used with vehicle safety belt buckles having safety belt releasing means thereon which is adapted to be operated to open the safety belt, and comprises a covering member for covering the buckle and for preventing or rendering more difficult the operation of the releasing means, and means for securing the covering member to the safety belt.

When the cover of the present invention is installed on a vehicle safety belt, the covering member covers the buckle thereof and renders operation of the releasing means, such as a button-type releasing means, substantially more difficult such that small children, in particular, are very unlikely to be able to operate it.

In accordance with a presently preferred embodiment of the invention, the covering member comprises a generally rectangular-shaped member comprised of an outer layer of flexible material such as a soft fabric, and a inner layer of a less flexible, relatively rigid material such as a plastic sheet or the like. The rectangular-shaped covering member is sized to substantially fully cover the upper surface of a safety belt buckle and the releasing button thereon so as to prevent operation of the releasing button.

The securing means preferably comprises a strap means affixed to the covering member and sized to extend around the back of the buckle to secure the covering member to the safety belt. Most preferably, the strap means comprises a pair of spaced strap means with the strap means of each pair comprising cooperating male and female Velcro straps which are adapted to overlap and engage one another to secure the cover member in position over the buckle.

The cover of the present invention can be quickly and easily installed onto or removed from a vehicle safety belt by an adult or older child. The construction of the cover, however, is such that a young child cannot readily remove the cover or operate the safety belt releasing means when the cover is installed.

The cover is preferably constructed of materials that are fully washable and is sufficiently small in size that it can be easily stored in a vehicle glove compartment, a purse or the like when not in use.

Further advantages and specific details of the invention will be more fully set forth hereafter in conjunction with the following detailed description of a presently preferred embodiment.

BEST MODE FOR CARRYING OUT THE INVENTION

Figure 1:
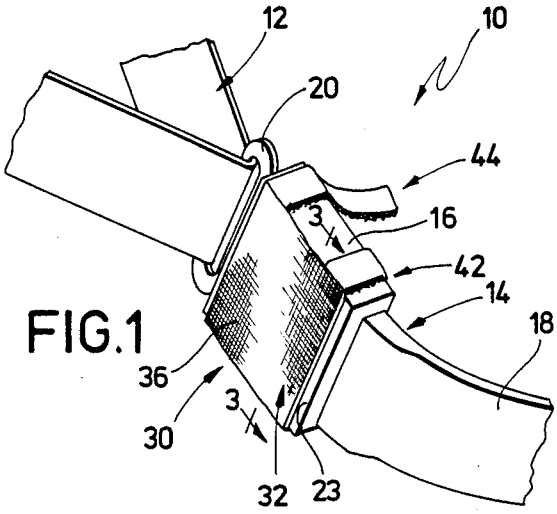
FIG. 1 is a perspective view of a portion of a vehicle safety belt having a safety belt cover according to a presently preferred embodiment of the invention installed thereon.
Figure 2:
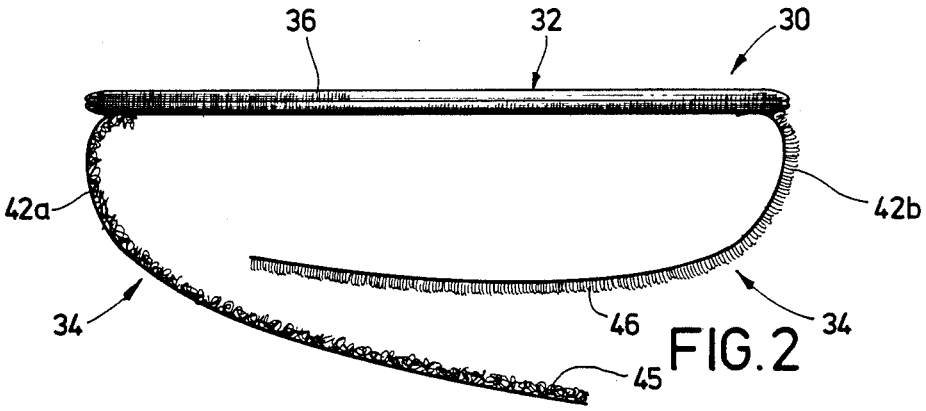
FIG. 2 is an end view of the cover of FIG. 1.
Figure 3:
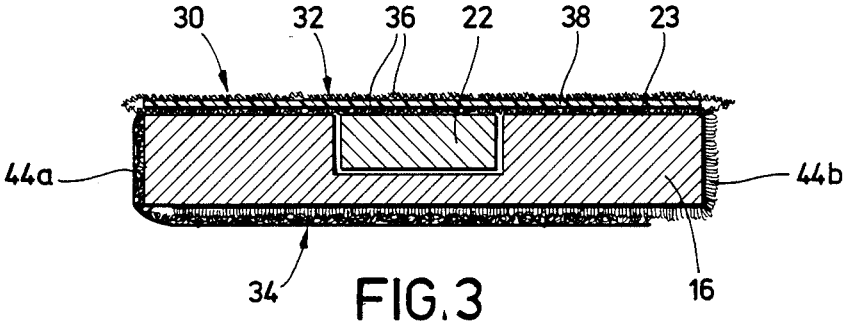
FIG. 3 is a cross-sectional view looking in the directions of arrows 3—3 in FIG. 1.

FIGS. 1—3 illustrate a cover for covering a buckle of a vehicle safety belt according to a presently preferred embodiment of the invention. Reference number 10 generally identifies a conventional vehicle safety belt such as is used in automobiles and other vehicles. The safety belt includes a belt portion 12 which is adapted to extend around the body of the user and a buckle portion 14 having a buckle 16 which is adapted to releasably engage the end of the belt portion to secure the safety belt in position around the user.

Buckle 16 is typically mounted to the end of a plastic supporting portion 18 which is secured to the vehicle as is known in the art. The belt portion typically includes a metal tongue 20 which is adapted to be inserted into a slot (not shown) in the side of the buckle, and when inserted is automatically secured to the buckle to lock the seat belt securely around the user.

Many vehicle safety belt buckles include a releasing means in the form of a button 22 to release the belt portion from the buckle portion when it is desired to open the safety belt. Button 22 is located in a substantially central position in the upper surface 23 of the buckle, and when depressed, operates a release mechanism in the buckle (not shown) to release the metal tongue and allow the belt portion to be withdrawn from the buckle.

Button 22 is designed to be easily operated with one finger to enable a person to quickly open the safety belt when desired. However, it can also be operated quite easily by even small children or infants permitting them to intentionally or accidentally open the safety belt thus exposing themselves to substantial danger. The present invention is particularly designed to prevent a small child from opening the safety belt by preventing the child from pressing releasing button 22.

Specifically, the present invention comprises a cover which is adapted to cover the upper surface 23 of buckle 16 and releasing button 22 thereon so as to prevent or render substantially more difficult the operation of button 22; and, therefore, make it unlikely that a small child can operate the button to open the safety belt. The cover is generally designated by reference number 30 and comprises a covering member 32 of generally rectangular shape which is sized to substantially cover the upper surface 23 of buckle 30, and means 34 for securing the covering member to the safety belt.

As best shown in FIG. 3, the covering member comprises an outer layer 36 of a soft, relatively flexible material, for example, a fabric material; and an inner layer 38 of a less flexible, relatively rigid material such as a plastic sheet or the like. The covering member can be easily manufactured, for example, by folding a piece of fabric material over the plastic sheet and then sewing the fabric material around the edges to enclose the plastic sheet within the outer layer of fabric material.

The securing means comprises first and second spaced pairs of straps 42 and 44 which can also be formed of a fabric material and which can be attached to the covering member by being sewn adjacent opposite edges thereof so as to extend from the edges of the covering member as shown in the FIGS. Each pair of straps 42 and 44 includes a first strap 42*a*, 44*a* having a layer of female Velcro material 45 on the inner surface thereof and a second strap 42*b*, 44*b* having a layer of male Velcro material 46 on the outer surface thereof. The straps of each pair are of sufficient length, for example, 2 inches, so that they will overlap one another when they are extended around the buckle 30.

To install cover 10 to a vehicle safety belt, the covering member 32 is positioned on the top surface 23 of buckle 16 so that it fully covers button 22. The male Velcro straps 42*b* and 44*b* of each pair of straps is then extended around the back of the buckle. The female Velcro straps 42*a* and 44*a* of each pair are then extended around the buckle to overlap the straps 42*b* and 44*b* so that the Velcro surfaces thereon will engage one another to attach the straps together and to secure the cover to the safety belt.

The use of Velcro strap to secure the cover to the safety belt permits the cover to be quickly and easily attached to and removed from the buckle by an adult and provides adjustability to accommodate buckles of different size. The securing means is such, however, that a small child cannot easily remove the cover.

When the cover of the invention is installed on a vehicle safety belt, the relatively rigid inner layer of the covering member will substantially prevent the releasing button from being operated, especially by a small child.

Although cover 10 can employ only a single pair of straps to secure the cover to the safety belt, it is preferred to provide two spaced pairs of straps as this permits one of the pairs of straps to be secured around the belt portion and the other pair of straps to be secured around the buckle. This tends to hold the cover more securely and to prevent the covering member from being slid off of the buckle so as to uncover the button.

The vehicle safety belt buckle cover of the present invention is small in size and can be easily stored in a vehicle glove compartment, in a purse, etc. The cover is also fully washable and can be used over and over. If desired, the fabric outer layer can be provided in a variety of different colors or with attractive designs and can be formed of different fabric materials.

It should also be understood that although the buckle described above employs a button-type releasing means, the cover of the present invention is also effective for vehicle safety belt buckles in which the release mechanism is operated by raising an edge of the buckle, as securing the cover around such a buckle will also tend to prevent operation of the releasing means of that type of buckle by small children.

While what has been described constitutes a presently most preferred embodiment of the invention, it should be recognized that the invention could take other numerous forms. For example, rather than providing securing means in the form of Velcro straps, straps employing buckles or the like, or other types of securing means may be employed.

Because the invention can take many other forms, it should be understood that the invention is to be limited only insofar as is required by the scope of the following claims.

I claim:

1. A cover for covering a buckle of a vehicle safety belt, said buckle having a safety belt releasing button on a surface thereof which is adapted to be depressed to open said safety belt, said cover comprising:

a generally rectangular-shaped covering member for substantially covering said surface of said buckle and said releasing button thereon, said covering member comprising an outer, flexible fabric layer and an inner, less flexible, relatively rigid sheet enclosed within said outer layer, said rigid sheet being sufficiently rigid to prevent or render more difficult the depressing of said button when said covering member covers said surface and said releasing button thereon; and securing means for releasably securing said cover to said safety belt, said securing means including first and second pairs of spaced strap means attached to and extending from said covering member adjacent opposite edges thereof and adapted to be extended around said safety belt for securing said cover to said safety belt.

2. The cover of claim 1 wherein said first and second pairs of strap means comprise first and second pairs of Velcro strap means, each of said first and second pairs of Velcro strap means including first and second straps of sufficient length to overlap and engage one another on the back of said safety belt when they are extended around the back of said safety belt.

* * * * *